US009551123B2

(12) United States Patent
Milani

(10) Patent No.: US 9,551,123 B2
(45) Date of Patent: Jan. 24, 2017

(54) BASIN FOR SWIMMING POOLS, ARTIFICIAL PONDS AND THE LIKE, AND METHOD FOR PROVIDING THE BASIN

(71) Applicant: BIODESIGN S.R.L., Masera di Padova (IT)

(72) Inventor: Alessandro Milani, Montegrotto Terme (IT)

(73) Assignee: BIODESIGN S.R.L., Masera di Padova (IT)

( * ) Notice: Subject to any disclaimer, the term of this patent is extended or adjusted under 35 U.S.C. 154(b) by 197 days.

(21) Appl. No.: 14/380,192

(22) PCT Filed: Feb. 20, 2013

(86) PCT No.: PCT/EP2013/053314
§ 371 (c)(1),
(2) Date: Aug. 21, 2014

(87) PCT Pub. No.: WO2013/124284
PCT Pub. Date: Aug. 29, 2013

(65) Prior Publication Data

US 2015/0047117 A1 Feb. 19, 2015

(30) Foreign Application Priority Data

Feb. 22, 2012 (IT) ..... PD2012A0043

(51) Int. Cl.
*E04H 4/14* (2006.01)
*E02B 1/00* (2006.01)
(Continued)

(52) U.S. Cl.
CPC ..... *E02B 1/00* (2013.01); *E02D 17/00* (2013.01); *E04H 4/00* (2013.01); *E04H 4/14* (2013.01)

(58) Field of Classification Search
CPC .... E04H 4/0075; E04H 4/0087; E04H 4/0093; E04H 4/00; E04H 4/14
See application file for complete search history.

(56) References Cited

U.S. PATENT DOCUMENTS 4,142,337 A 3/1979 Holcomb
5,192,162 A * 3/1993 McKinnon ..... E04H 4/005 4/506

(Continued)

FOREIGN PATENT DOCUMENTS

EP 1043456 A1 10/2000
FR 2436860 A1 4/1980
GB 2045605 A 11/1980

OTHER PUBLICATIONS

International Search Report (PCT/ISA/210) for PCT/EP2013/053314 mailed Jul. 3, 2013 and Written Opinion of the International Searching Authority (PCT/ISA/237).

(Continued)

*Primary Examiner* — Janie Loeppke
(74) *Attorney, Agent, or Firm* — Themis Law

(57) ABSTRACT

A basin for swimming pools, artificial ponds and the like, includes, within the bed excavated in the ground for its provision, a layer for protecting the internal surface of the bed, a first waterproofing layer, above the protective layer, an internally hollow structure, which is placed on the first waterproofing layer and whose inner face, directed toward the inside of the basin, is contoured or vertical, in order to provide a correspondingly shaped or substantially vertical wall of the central tank of the basin, a protective layer and a waterproofing layer for the outer face of the hollow structure, and a second waterproofing layer for the inner face of the hollow structure.

15 Claims, 8 Drawing Sheets

(51) Int. Cl.
*E04H 4/00* (2006.01)
*E02D 17/00* (2006.01)

(56) References Cited

U.S. PATENT DOCUMENTS

2008/0245465 A1* 10/2008 Milani ..... E04H 4/00
156/71
2010/0115691 A1 5/2010 Van Der Klooster

OTHER PUBLICATIONS

Italian Search report for IT PD20120043 dated Jan. 25, 2013.

* cited by examiner

BASIN FOR SWIMMING POOLS, ARTIFICIAL PONDS AND THE LIKE, AND METHOD FOR PROVIDING THE BASIN

The present invention relates to a basin for swimming pools, artificial ponds and the like.

The present invention also relates to a method for providing said basin.

Currently, in-ground swimming pools, fountains, and artificial ponds in general, provided according to the teachings described and claimed in Italian patent no. 0001361065 in the name of Mr. Milani Alessandro, are known and are increasingly widespread and appreciated.

These in-ground swimming pools, or fountains or artificial ponds are provided by means of a method that entails

- a step of excavating the bed,
- the excavation of a perimetric channel for draining the rain water,
- the provision, on the bottom of the basin, of a leveling layer of sand, clay or other similar and suitable material,
- the arrangement of the plumbing system and the electrical system,
- the laying of a layer for protecting the inner surface of the basin, which comprises for example at least one sheet made of fabric or non-woven fabric, of the type of geotextiles, geogrids and other similar products of a type known per se,
- the covering of the bed with a layer of waterproofing material, with overlapping regions of the sheets used, so that the waterproofing layer can be deformed by elongation in order to compensate for any settling of the ground due to geological factors or load factors,
- the covering of the waterproofing layer with a covering layer that comprises natural or artificial stones, which are arranged mutually adjacent and optionally joined by a bonding agent and are arranged so as to form interstices for the passage of water to the waterproofing layer, so that the pressure of the water is discharged against this layer without compromising the integrity of the covering made of stones or the like.

This system for providing swimming pools, ponds and the like is increasingly widespread and highly regarded for its significant advantages in terms of very low environmental impact, due to the substantial absence of the use of structures made of concrete, due to the total weight of the system, which is remarkably lower than classic swimming pools with a concrete tank made of cement, and due to the related advantages in terms of building permits, since in practice this is an easily removable provision; all advantages that make these swimming pools or ponds particularly inexpensive with respect to the other types.

Despite the cited advantages, swimming pools and ponds provided by means of this method have a limitation, which is linked to the substantial impossibility to provide a basin that has at least one vertical wall, which is a very important aspect for a buyer who wishes to have a swimming pool or pond that at least in part is immediately deep with respect to the rim, whereas with the method described above it is only possible to provide basins the depth of which increases progressively from the rim toward the center.

The aim of the present invention is to provide a basin for swimming pools, artificial ponds and the like that is capable of obviating the cited drawbacks of the background art.

Within this aim, an object of the invention is to provide a basin that has one or more vertical or contoured walls.

Another object of the invention is to devise a basin that benefits from all the advantages of the above cited basins for swimming pools and ponds of the known type.

A further object of the invention is to devise also a particular method for providing such a basin.

Another object of the invention is to provide a basin that is easily and quickly installed.

Another object of the invention is to propose a basin for swimming pools, artificial ponds and the like, as well as a method for providing it, that can be provided with known systems and technologies.

This aim and these and other objects that will become more apparent hereinafter are achieved by a basin for swimming pools, artificial ponds and the like, characterized in that it comprises, within the bed excavated in the ground, for its provision,

- a layer for protecting the internal surface of the bed,
- a first waterproofing layer, above the protective layer,
- an internally hollow structure, which is arranged on the first waterproofing layer and whose inner face, directed toward the inside of the basin, is contoured or vertical, so as to provide a correspondingly contoured or substantially vertical wall of the central tank of the basin,
- a protective layer and a waterproofing layer for the outer face of said hollow structure,
- and a second waterproofing layer for said inner face of said hollow structure.

Further characteristics and advantages of the invention will become more apparent from the description of a preferred but not exclusive embodiment of the basin according to the invention and of a method, also according to the invention, for its provision, illustrated by way of non-limiting example in the accompanying drawings, wherein.

Figure 1:
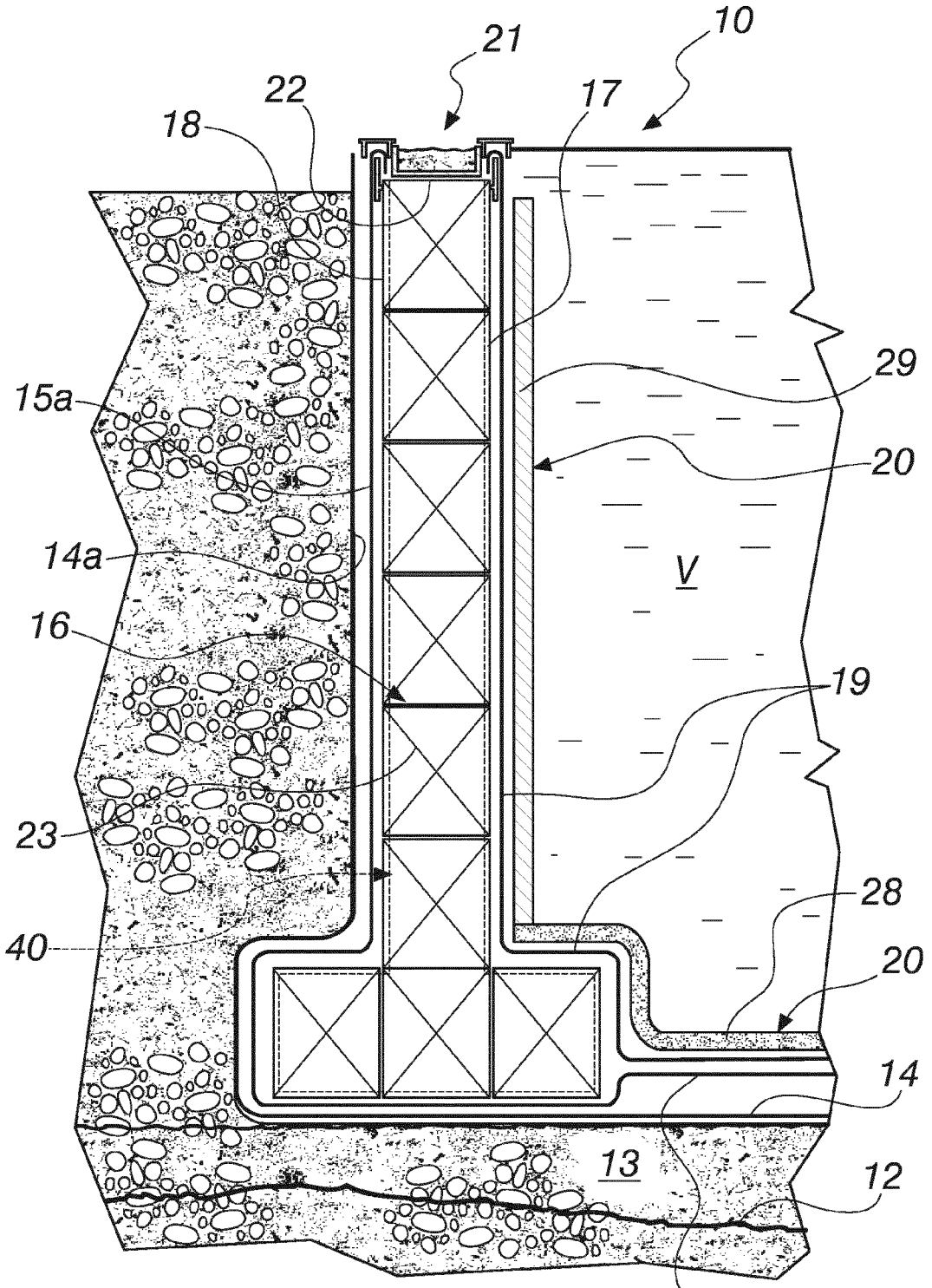
FIG. 1 is a schematic lateral view of a detail of a basin according to the invention.

With reference to the figures, a basin for swimming pools, artificial ponds and the like is generally designated by the reference numeral 10.

The basin 10 comprises, inside the bed 11 excavated in the ground for its provision, possibly, on the bottom 12 of the bed 11, a leveling layer 13 that can be made of sand, clay or other similar and suitable material;

a layer 14 for protecting the inner surface of the bed 11, a first waterproofing layer 15 above the protective layer 14, an internally hollow structure 16 arranged on the first waterproofing layer 15 whose inner face 17, directed toward the inside of the basin 10, is contoured or vertical, so as to provide a correspondingly contoured or substantially vertical wall of the central tank V of the basin 10, a protective layer and a waterproofing layer for the outer face 18 of said hollow structure 16, described in more detail further on, a second waterproofing layer 19 for the inner face 17 of the hollow structure 16, a covering layer 20 for the inner surface of the basin 10, and means 21, described in more detail further on, for the passage and filtration of the water that overflows from the central tank V, which is inside the basin 10, toward the inside of the hollow structure 16; said means 21 are arranged at the upper face 22 of said hollow structure 16.

The protective layer 14 is constituted for example by one or more sheets made of fabric or non-woven fabric of what is called the geotextile type, or provided by means of geogrids or other similar and equivalent elements.

The first waterproofing layer 15 is provided by means of one or more sheets of EPDM (Ethylene-Propylene Diene Monomer), or other similar and equivalent materials having such elasticity properties as to allow the underlying ground to shift, as a consequence of geologic settlings or for other reasons, without causing problems to the waterproofing.

The waterproofing layer can be optionally applied with substantially S-shaped folds in order to compensate for elongations.

In the embodiment of the invention described herein by way of non-limiting example of the invention itself, the hollow structure 16 is constituted by a framework 23 made of plastic material, which is composed of a vertical central body 24 and a resting base 25.

In particular, the framework 23 is provided by a plurality of parallelepipedal modules 26.

Figure 9:
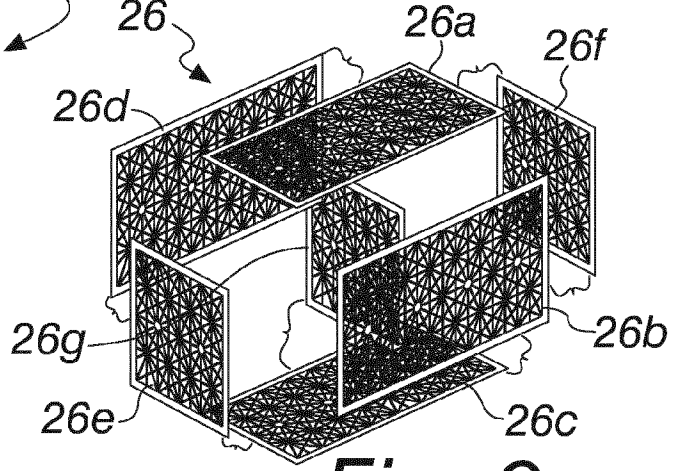
FIG. 9 is an exploded perspective view of the detail in FIG. 8.
Figure 8:
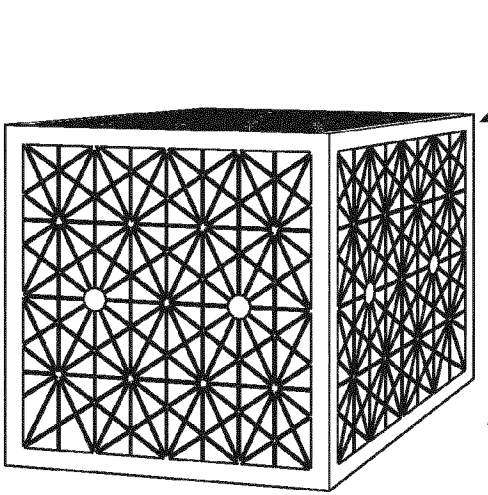
FIG. 8 is a perspective view of a detail of the hollow structure.

Each one of the parallelepipedal modules 26, one of which is exemplified in FIGS. 8 and 9, is constituted for example by a honeycomb module for the provision of draining trenches, of a type known per se, composed, for example, of six external grid-like panels 26*a*, 26*b*, 26*c*, 26*d*, 26*e*, 26*f*, and an inner reinforcement panel 26*g*.

Figure 10:
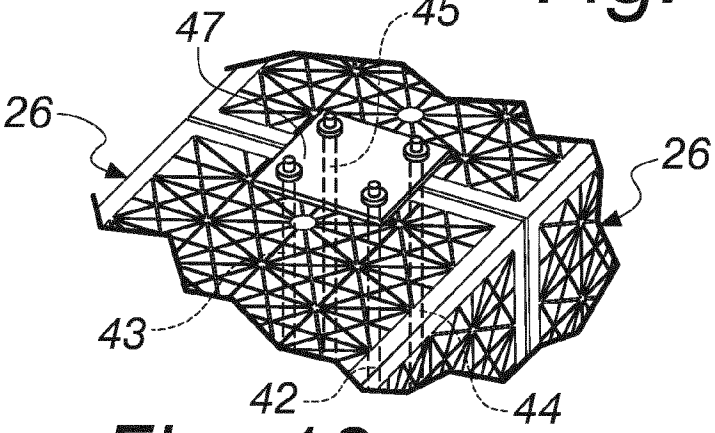
FIG. 10 is a view of a detail of the hollow structure according to the invention.

These modules 26, made of plastic material, are particularly light, therefore easy to transport and handle, and can be easily connected to each other, for example by means of a series of vertical tension members, 42 and 43 in FIGS. 11 and 42, 43, 44 and 45 in FIG. 10, and a series of horizontal tension members 46 at the base 25.

As exemplified in FIG. 10, the columns of side-by-side modules 26 are joined horizontally by means of mutually opposite plates 47 and 48 closed between the end heads of the tension members.

This system for the connection of the modules 26 is to be understood as a non-limiting example of the invention, since other means for joining the modules are to be understood as being usable in a similar and functionally equivalent manner.

An equivalent hollow structure is to be understood as providable also by means of other materials and systems, for example made of concrete, albeit with fewer advantages in terms of weight and ease of installation.

Figure 2:
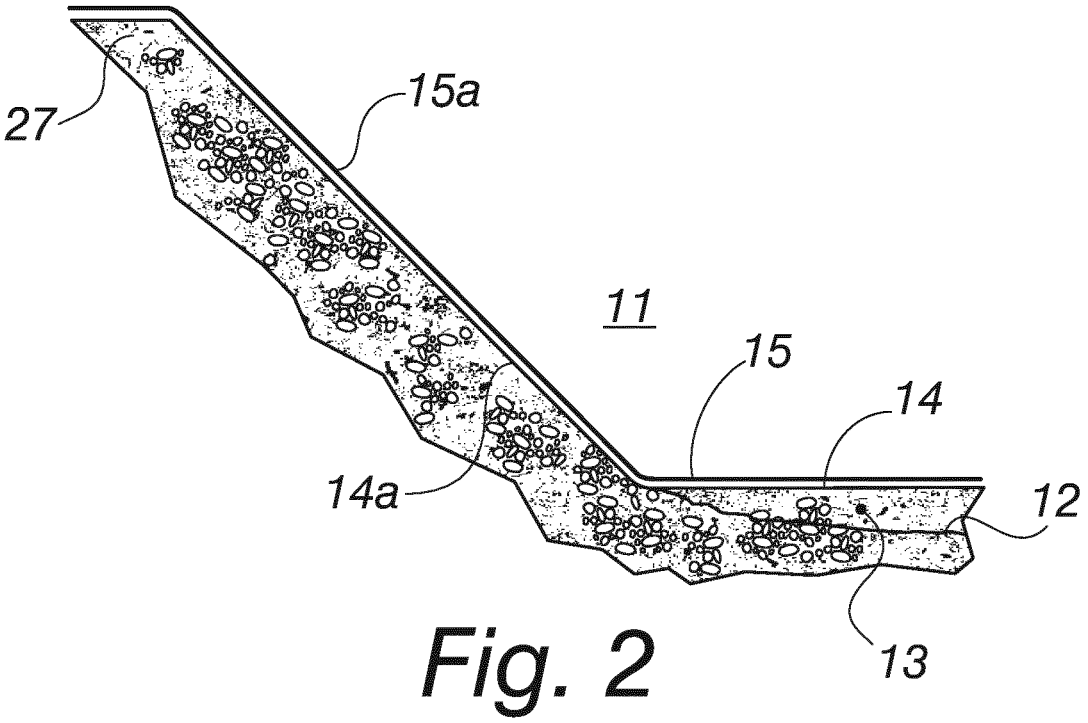
FIG. 2 is a view of a first part of the method for providing a basin according to the invention.
Figure 3:
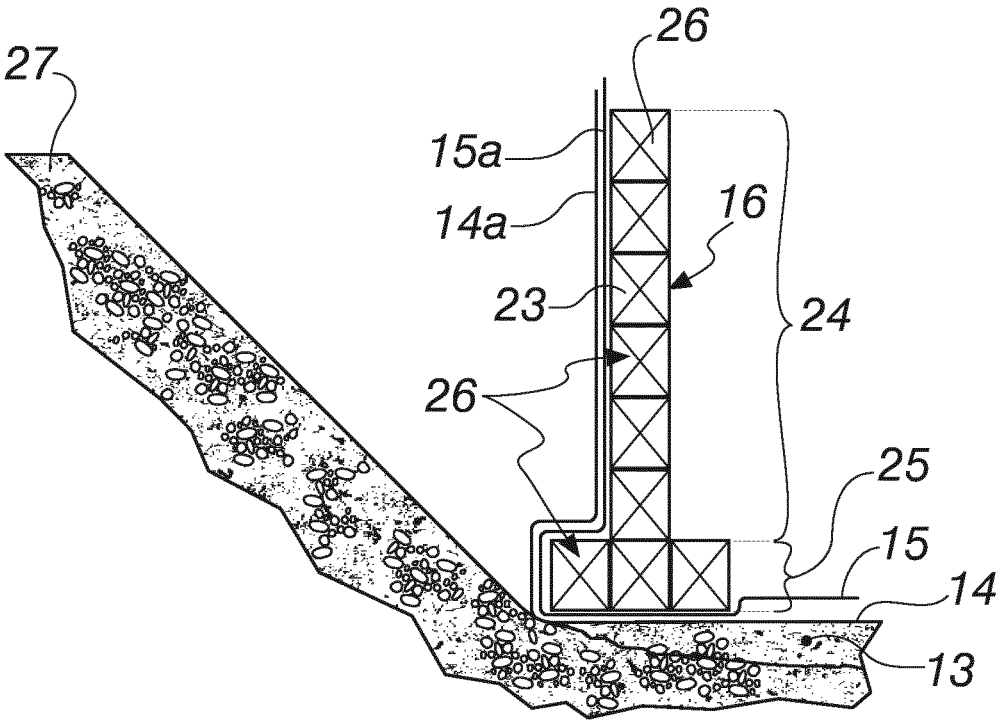
FIG. 3 is a view of a second part of the method for providing a basin according to the invention.

The protective layer and the waterproofing layer of the outer face 18 of the hollow structure 16 are formed, in the present constructive example, by the portions 14*a* and 15*a* of the protective layer 14 and first waterproofing layer 15 that are applied on the inner surface of the bed 11 in the region between the hollow structure 16 and the nearby rim 27 of the bed 11, as in FIGS. 2 and 3.

The second waterproofing layer 19 for the internal face 17 of the hollow structure 16 is constituted by one or more additional sheets of EPDM or the like, as described for the first waterproofing layer 15.

There can be, for example, two different solutions for the covering layer 20 for the internal surface of the basin 10, a first covering 28 for the bottom of the basin and a second covering 29 for the vertical inner face 17 of the hollow structure 16.

The first covering 28 is constituted, for example, by natural or synthetic stones, or glass granulates, arranged mutually side by side and optionally joined by a bonding agent, arranged so as to form interstices for the passage of the water to the waterproofing layer 19, so that the pressure of the water is discharged against said waterproofing layer, and therefore to the ground, without compromising the integrity of the covering made of stones or the like.

As an alternative, the first layer 28 is constituted by a casting of concrete, applied and leveled on the waterproofing layer 19, in this case also without structural functions, and with through holes for the passage of the water.

The second vertical covering 29 is of the same type as the first covering 28, or can be provided by applying on the inner face 17 adapted panels, for example made of fiber-reinforced plastic, or honeycomb panels made of plastic material or aluminum, or resin and concretes, covered by a thin layer of resins and inert materials, or by ceramic or concrete coverings.

The waterproofing layers 15*a* and 19 are fixed to the hollow structure 16 by the respective upper flaps 30 and 31, which are folded around corresponding side walls 32 and 33 that extend upward from the hollow structure 16 itself.

The upper flaps 30 and 31 are pinched and retained in position by the application of C-shaped profiles 34 and 35, which are contoured so as to straddle the respective side walls 32 and 33 with the flaps 30 and 31 interposed.

The C-shaped profiles 34 and 35 are fixed to the side walls by quick-coupling means, for example by means of the C-shaped profiles themselves shaped as clips, i.e., with the lateral walls that converge so as to pinch the flaps 30 and 31 on the corresponding side walls 32 and 33.

The side walls 32 and 33 are coupled to the hollow structure 16 by means that allow their adjustment in terms of height, for example systems with slots for corresponding threaded locking elements arranged to slide in said slots, means to be understood therefore as being of a type known per se; this adjustment of the height is decisive for ensuring the same overflow level for the water that is present in the basin 10 along the entire perimeter of the basin itself.

This adjustment of the height of the side walls 32 and 33 allows a correction of their position if ground settling compromises their necessary horizontal arrangement.

The water can in fact overflow between the side walls 32 and 33 in order to flow inside the hollow structure 16, passing through the passage and filtration means 21.

The passage and filtration means 21 are constituted, for example, by a series of mutually adjacent trays 37, with a perforated draining bottom, optionally filled with draining covering materials 38.

In particular, and preferably, the draining covering material 38 is constituted by resin-treated inert material, with the addition of antibacterial agents and bactericidal agents, for sanitizing the water that overflows from the inside of the basin 10 and through the draining covering material 38 inside the hollow structure 16, where between the inner face 17 and the outer face 18 an accumulation and compensation tank, shown in broken lines and designated by the reference numeral 40, is advantageously formed.

The accumulation and compensation tank 40 makes it possible to avoid the construction of an adapted compensation tank as in the background art, a construction which is generally invasive in environmental terms and expensive in terms of space, components and labor.

The accumulation and compensation tank 40 is formed between the portion 15*a* of the first waterproofing layer 15 and the second waterproofing layer 19 that surround the framework 23, and means for returning the water from the accumulation and compensation tank to the central tank of the basin can be associated therewith, so as to determine what is called a spillway system for the basin 10.

The means for returning the water from the accumulation tank 40 to the central tank are constituted by traditional pumping and filtration systems known per se.

The invention also relates to a method for providing a basin 10 as described above.

Figure 4:
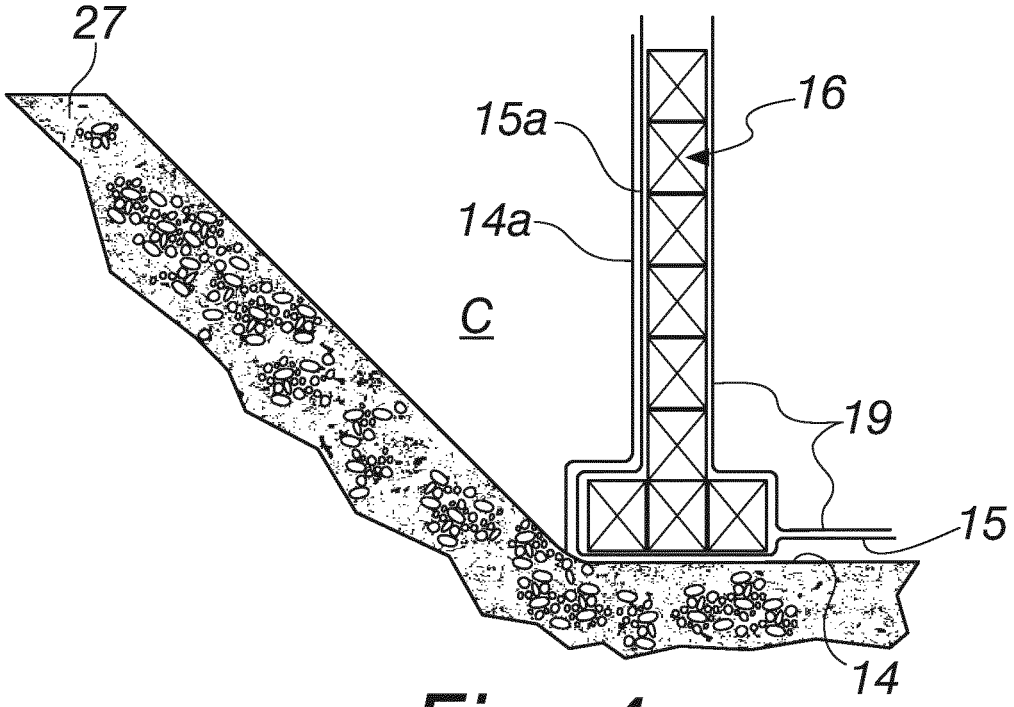
FIG. 4 is a schematic view of a third part of the method for providing the basin according to the invention.
Figure 5:
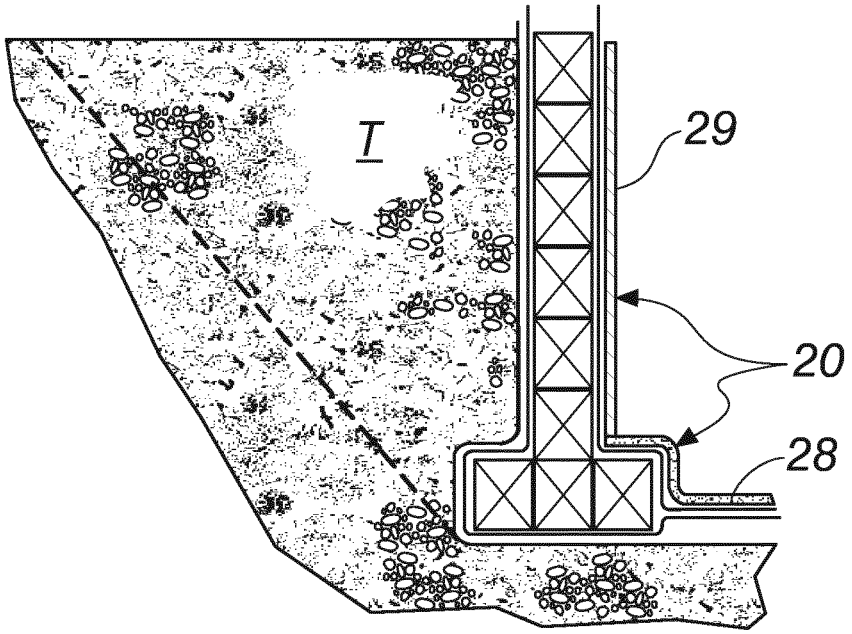
FIG. 5 is a schematic view of a fourth part of the method for providing the basin according to the invention.
Figure 6:
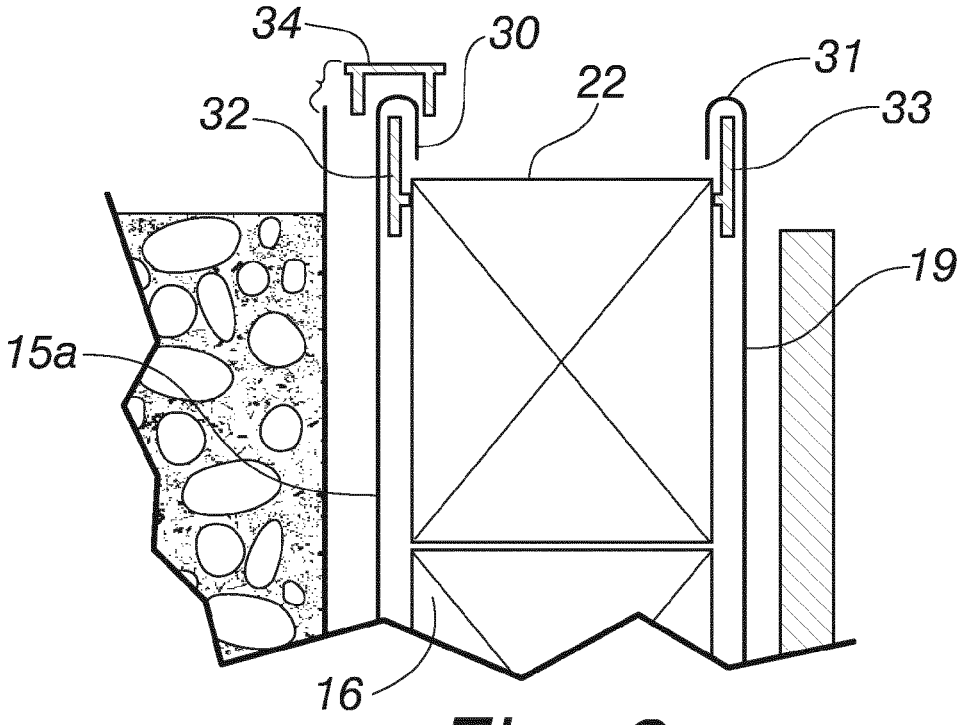
FIG. 6 is a schematic view of a fifth part of the method for providing the basin according to the invention.
Figure 7:
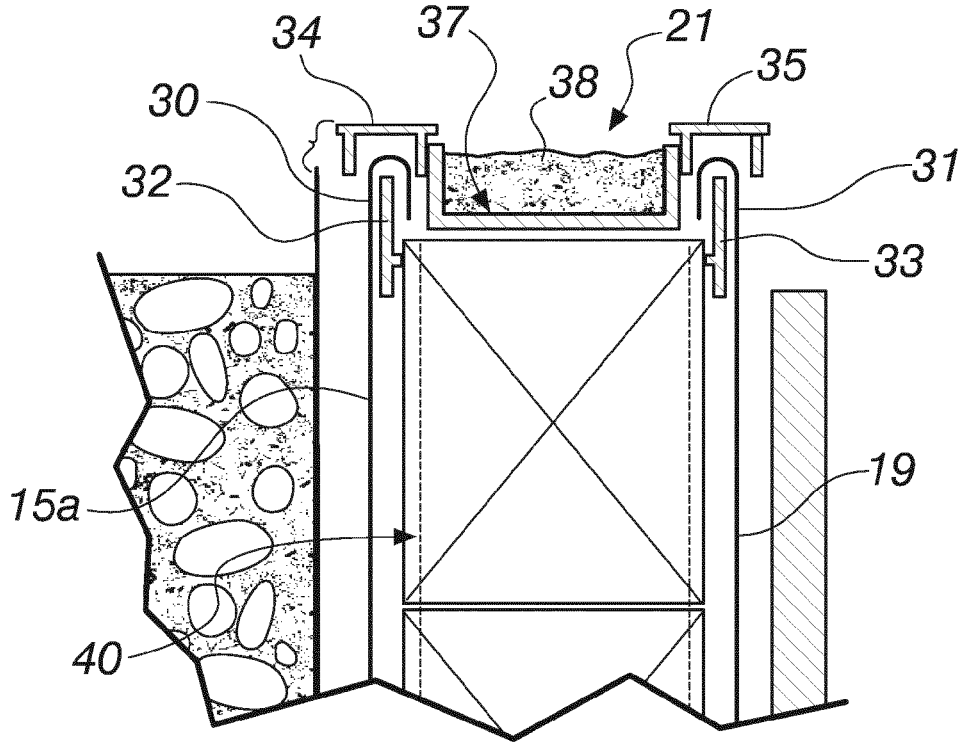
FIG. 7 is a schematic view of a sixth part of the method for providing the basin according to the invention.
Figure 11:
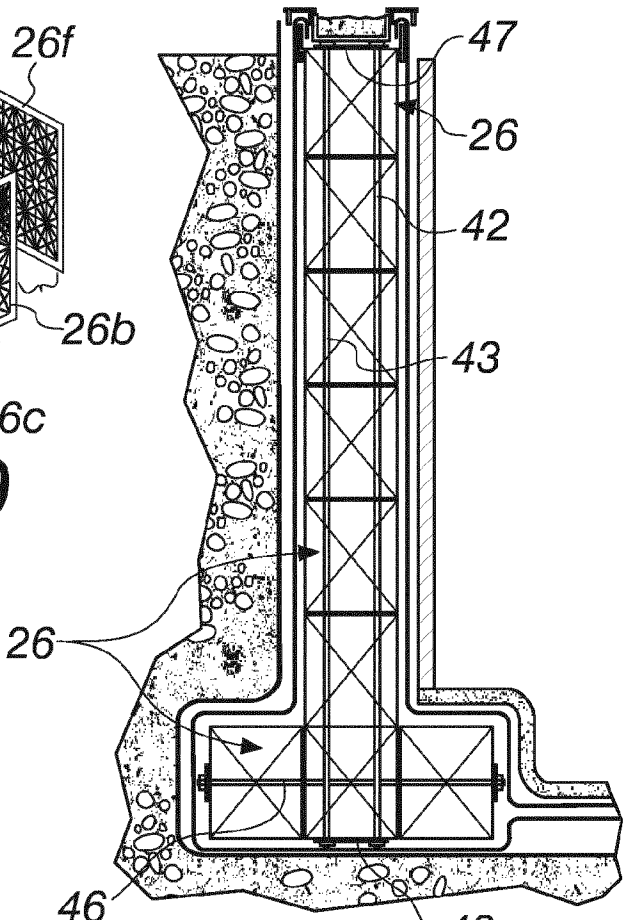
FIG. 11 is a schematic lateral view of the hollow structure of the basin according to the invention.

This method provides for the following operations:

- excavating the bed 11 designed to accommodate the basin 10, as in FIG. 2,
- optionally providing, on the bottom 12, a leveling layer 13 of sand, clay or other similar and suitable material, as in FIG. 2,
- laying a layer 14 for protecting the inner surface of the bed 11, as in FIG. 2,
- covering the protective layer 14 with a first waterproofing layer 15, preferably with overlapping regions of the sheets used, as in FIG. 2,
- providing, as in FIG. 3, on the first waterproofing layer 15 an internally hollow structure 16 whose inner face 17, directed toward the inside of the basin, is substantially vertical, adapted to provide a substantially vertical wall of the central tank V,
- covering the outer face 18 of the hollow structure 16 with a protective layer 14*a* and with a waterproofing layer 15*a*, as in FIG. 3; said covering being provided by using the portions 14*a* and 15*a* of the protective layer 14 and first waterproof layer 15 themselves, which are applied on the inner surface of the bed 11 in the cavity C between said hollow structure 16 itself and the nearby rim 27 of the bed 11,
- covering the inner face 17 with a second waterproofing layer 19, as in FIG. 4,
- filling, with fill soil T or other similar and equivalent material, the cavity C between said covered hollow structure 16 and the rim 27 of the bed 11, as in FIG. 5,
- covering the second waterproofing layer 19 with a covering layer 20, as in FIG. 5,
- closing said waterproofing layers 15*a* and 19 on the upper edges of the hollow structure 16, so as to form an accumulation and compensation tank 40 inside said hollow structure 16,
- forming, at the upper face 22 of the hollow structure 16, passage and filtration means 21 for the water that overflows from the central tank V of the basin 10 toward the inside of the hollow structure 16.

The method also comprises the operations of excavating a perimetric channel for draining rainwater and of placing the plumbing system and the electrical system, which are operations known per se that accordingly are neither described nor illustrated.

The details cited in the method are to be understood as corresponding to what has been described above for the basin 10 according to the invention.

The method comprises also a step for providing the covering layer, with the laying of natural or artificial stones, which are arranged mutually adjacent and optionally joined by a bonding agent and are arranged so as to form interstices for the passage of water to the waterproofing layer, so that the pressure of the water is discharged against said layer without compromising the integrity of the covering made of stones or the like.

Advantageously, the covering layer can comprise granules bonded with resin, wherein said bonding resin comprises one or more bactericidal agents and/or bacteriostatic agents and/or antibacterial agents in general.

Figure 12:
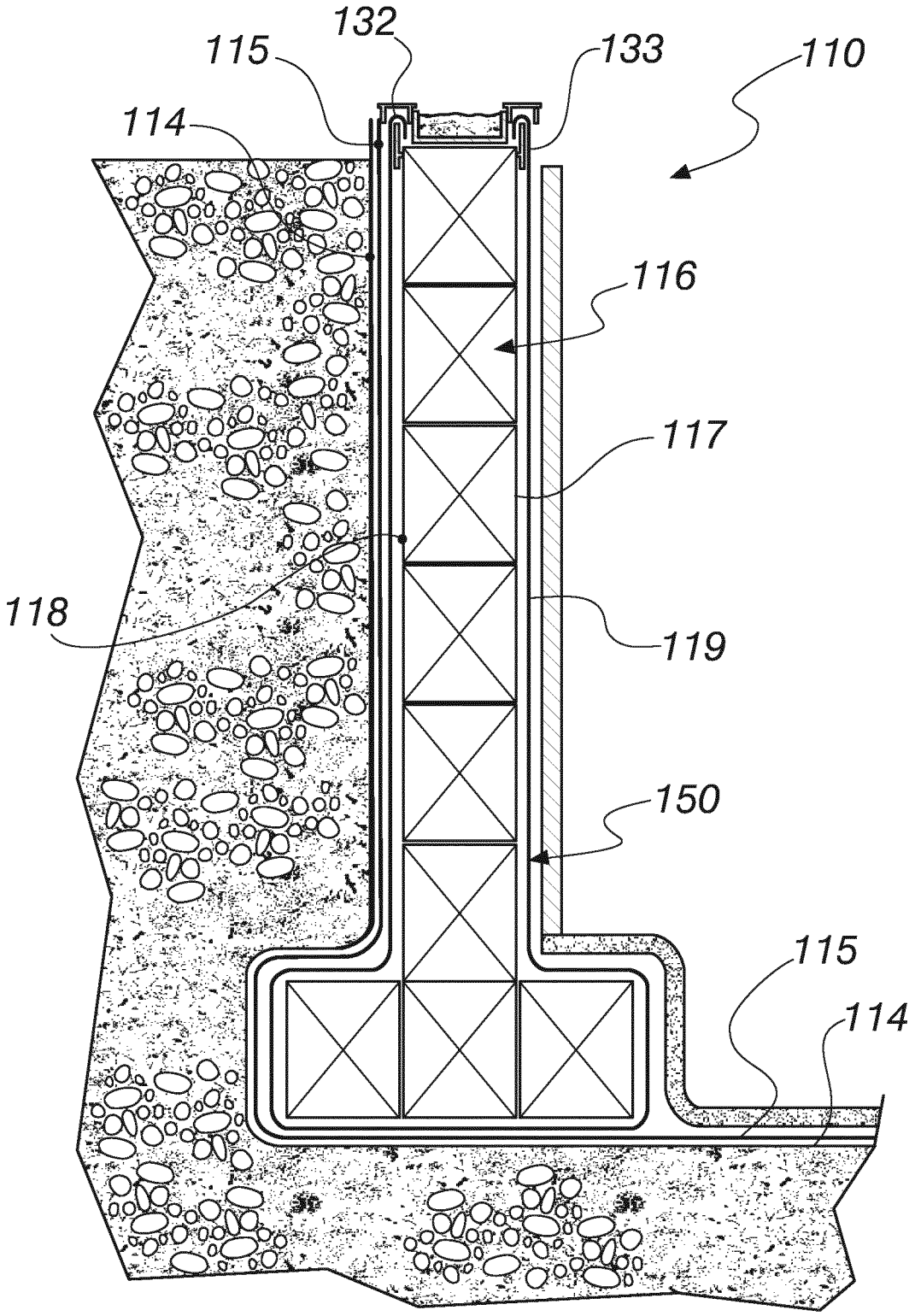
FIG. 12 is a schematic lateral view of a second embodiment of a basin according to the invention.

FIG. 12 is a schematic view of a second embodiment of a basin according to the invention, designated generally by the numeral 110.

This basin 110 has

- a layer 114 for protecting the inner surface of the bed,
- a first waterproofing layer 115, above the protective layer 114,
- an internally hollow structure 116, which is placed on the first waterproofing layer 115,
- a protective layer and a waterproofing layer for the outer face 118 of said hollow structure 116,
- a second waterproofing layer 119 for the inner face 117 of the hollow structure 116.

The first waterproofing layer 115 forms the waterproofing layer for the outer face 118 and is constituted by the same waterproofing sheet that also forms the second waterproofing layer 119 for the inner face 117.

As in FIG. 12, therefore, a single waterproofing sheet 150 envelops the hollow structure 116 laterally and on the bottom, covering both the inner face 117 and the outer face 118.

The flaps of the waterproofing sheet 150 are blocked to the side walls 132 and 133 in the same manner as described above.

Figure 13:
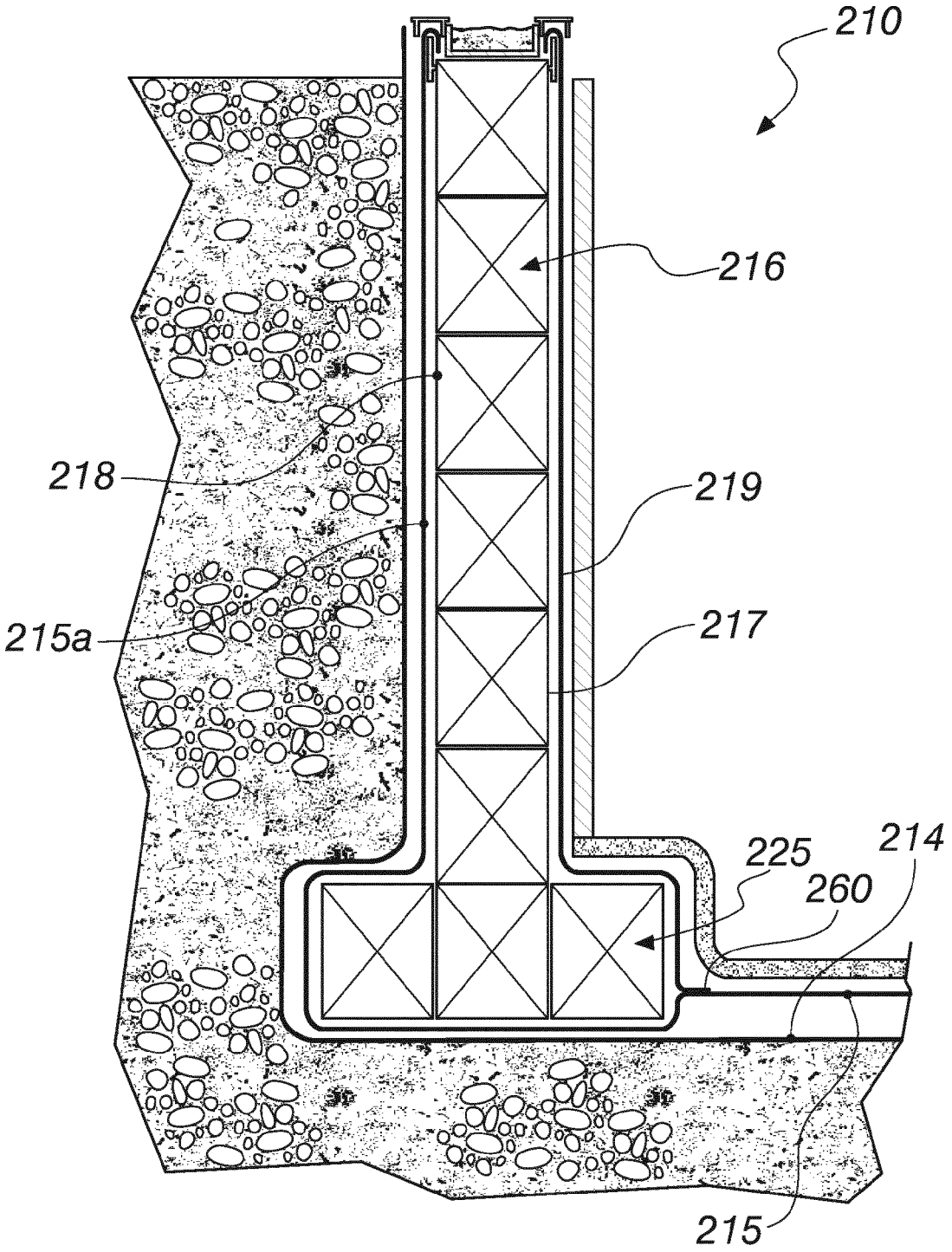
FIG. 13 is a schematic lateral view of a third embodiment of a basin according to the invention.

FIG. 13 is a schematic view of a third embodiment of a basin according to the invention, designated as a whole by the numeral 210.

The basin 210 has

- a layer 214 for protecting the internal surface of the bed,
- a first waterproofing layer 215, above the protective layer 214,
- an internally hollow structure 216, which is arranged on the first waterproofing layer 215,
- a protective layer and a waterproofing layer for the outer face 218 of said hollow structure 216,
- a second waterproofing layer 219 for the inner face 217 of the hollow structure 216.

The waterproofing layer of the outer face 218 of the hollow structure 216 is formed by the portion 215*a* of said first waterproofing layer 215 applied on the inner surface of the bed, with the second waterproofing layer 218 arranged so as to affect only the inner face 217 of the hollow structure 216, connected to the first waterproofing layer 215 at the base 225 of the hollow structure, for example in the region designated by 260 in FIG. 13, for example by heat-sealing or gluing or vulcanization.

Figure 14:
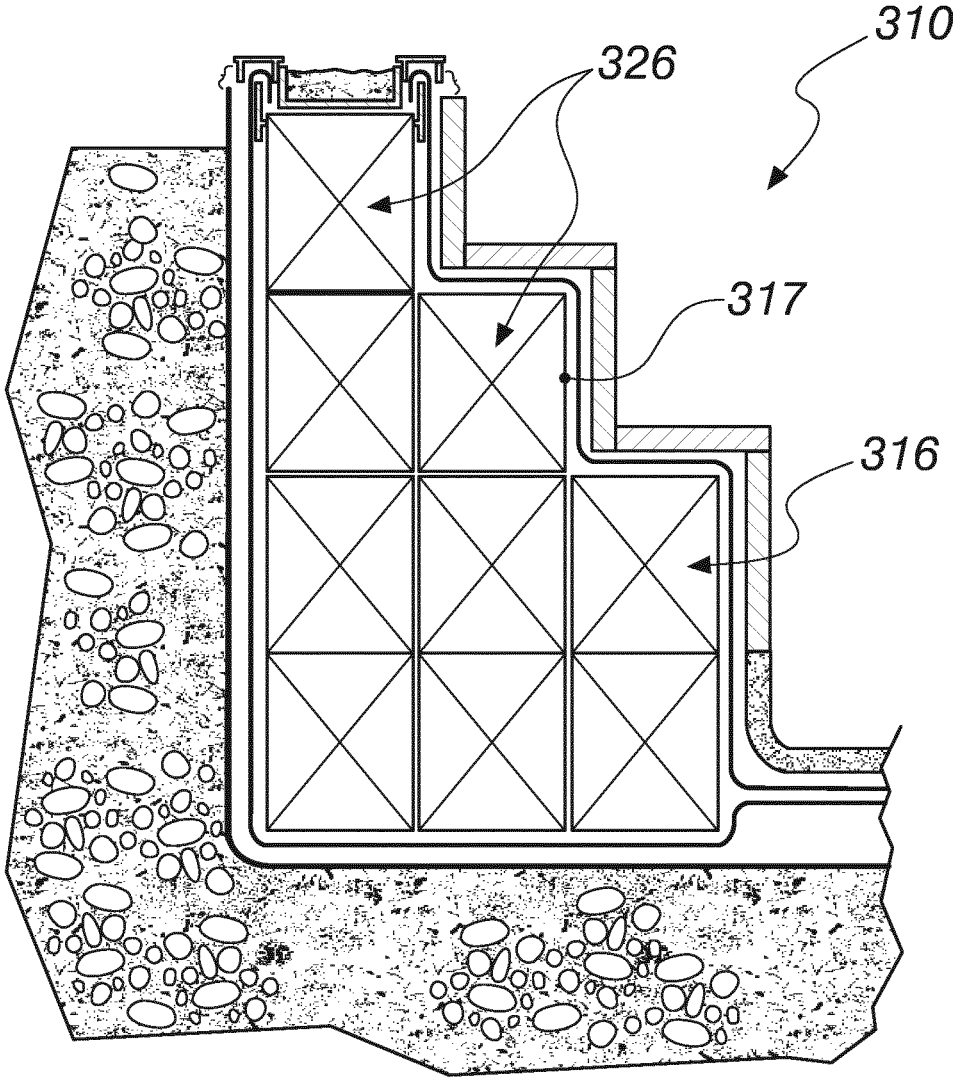
FIG. 14 is a schematic lateral view of a fourth embodiment of a basin according to the invention.

In a fourth embodiment of a basin according to the invention, designated in FIG. 14 by the numeral 310, the hollow structure 316 is provided by modules 26 arranged so as to form an inner face 317 with steps, obviously to be understood as being waterproofed and covered as described above.

The stepped wall that is formed is to be understood as an example of the shapes that can be provided with a basin according to the invention.

Such a basin according to the invention is therefore also particularly advantageous for renovating old tanks with a parallelepipedal bed, since it is possible to provide a basin according to the invention inside the existing bed, arranging the parallelepipedal modules 26 so that the hollow structure 16 takes a preset desired shape, to be waterproofed and covered with the means and methods described above.

In practice it has been found that the invention achieves the intended aim and objects.

In particular, the invention has provided a basin for swimming pools, artificial ponds and the like that has at least one vertical or contoured wall, where it is understood that said wall can extend along the entire perimeter of the inner tank or only on part of the perimeter of the inner tank of the basin, with the remaining basin provided as in patent no. 0001361065 in the name of Alessandro Milani, filed on Sep. 9, 2005.

Moreover, the invention has provided a basin that has all the advantages of the above-cited basins for swimming pools and ponds of the known type and those to which the patents in the name of Alessandro Milani and Biodesign Srl relate.

Moreover, the invention discloses a basin the total weight of which is much lower than the volume of occupied ground, and for this reason it ensures smaller telluric movements of said surrounding ground.

Moreover, the hollow structure, despite being light and non-invasive, is capable, if conveniently filled with water progressively and proportionally to the filling of the space between the bed and the outside of said hollow structure, of withstanding the pressure of said fill soil around the hollow structure.

Furthermore, the invention has also provided a particular method for providing such a basin.

Moreover, the invention has provided a basin that is simple and quick to install.

Last but not least, the invention has provided a basin for swimming pools, artificial ponds and the like, as well as a method for its provision, that can be provided with known systems and technologies.

The invention thus conceived is susceptible of numerous modifications and variations, all of which are within the scope of the appended claims; all the details may further be replaced with other technically equivalent elements.

In practice, the materials used, as well as the contingent shapes and dimensions, may be any according to requirements and to the state of the art.

The disclosures in Italian Patent Application No. PD2012A000043 from which this application claims priority are incorporated herein by reference.

The invention claimed is:

1. A basin for swimming pools or artificial ponds provided in a bed excavated in a ground, comprising:

a protective layer, protecting an internal surface of the bed;

a first waterproofing layer, disposed above the protective layer;

an internally hollow structure, which is placed on the first waterproofing layer and whose inner face, directed toward an inside of the basin, is contoured or vertical to provide a correspondingly shaped or substantially vertical wall of a central tank of the basin;

a protective layer and a waterproofing layer for an outer face of said hollow structure; and a second waterproofing layer for said inner face of said hollow structure, the first waterproofing layer and the second waterproofing layer entirely enclosing the hollow structure except at an upper face thereof provided at an upper edge of the basin, wherein an accumulation and compensation tank is formed within the hollow structure, the accumulation and compensation tank receiving water overflowing from the central tank.

2. The basin according to claim 1, further comprising:

a covering layer for an inner surface of said basin, and passage and filtration means for the water that overflows from the central tank of the basin toward an inside of said hollow structure, said means being arranged at the upper face of said hollow structure.

3. The basin according to claim 1, wherein said protective layer is constituted by one or more sheets made of a geotextile fabric.

4. The basin according to claim 1, wherein said first waterproofing layer is provided by one or more sheets of EPDM (Ethylene Propylene Diene Monomer).

5. The basin according to claim 1, wherein said hollow structure comprises a framework made of a plastic material, which is composed of a vertical central body and a resting base.

6. The basin according to claim 5, wherein said framework is provided by a plurality of parallelepipedal modules.

7. The basin according to claim 1, wherein said protective layer and said waterproofing layer of the outer face of the hollow structure are formed by portions of said protective layer and of said first waterproofing layer applied on the internal surface of the bed in a region between the hollow structure and a nearby rim of the bed.

8. The basin according to claim 1, wherein said second waterproofing layer for the inner face of the hollow structure is constituted by one or more sheets of EPDM.

9. The basin according to claim 2, wherein said covering layer for an internal surface of the basin comprises a first covering for a bottom of the basin and a second covering for a vertical inner face of the hollow structure.

10. The basin according to claim 1, wherein said waterproofing layers are fixed to the hollow structure by respective upper flaps, which are folded around corresponding side walls that extend upward from said hollow structure, said upper flaps being pinched and retained in position by application of C-shaped profiles, which are contoured to straddle respective side walls with said flaps interposed.

11. The basin according to claim 10, wherein said side walls are coupled to the hollow structure by means that allow their adjustment in terms of height.

12. The basin according to claim 2, wherein said passage and filtration means are constituted by a series of trays, with a perforated draining bottom, filled with a draining covering material.

13. A method for providing a basin for tanks or artificial ponds, comprising:

excavating a bed accommodating the basin;

laying a protective layer, protecting an inner surface of the bed;

covering the protective layer with a first waterproofing layer;

providing, on the first waterproofing layer, an internally hollow structure whose inner face, directed toward an inside of the basin, is substantially vertical, thereby providing a substantially vertical wall of a central tank;

covering an outer face of the hollow structure with a protective layer and with a waterproofing layer;

covering the inner face with a second waterproofing layer;

filling, with fill soil or other material, a cavity between said covered hollow structure and a rim of the bed;

covering the second waterproofing layer with a covering layer;

engaging said waterproofing layers to upper edges of the hollow structure, so as to form an accumulation and compensation tank inside said hollow structure; and forming, at an upper face of the hollow structure, passage and filtration means for water that overflows from the central tank toward the inside of said hollow structure, wherein the first waterproofing layer and the second waterproofing layer entirely enclose the hollow structure except at the upper face thereof, and wherein an accumulation and compensation tank is formed within the hollow structure, the accumulation and compensation tank receiving water overflowing from the central tank through the passage and filtration means.

14. The method according to claim 13, wherein the covering of said outer face is provided by using portions of said protective layer and of said first waterproofing layer that are applied on the inner surface of the bed in the cavity between said hollow structure and the nearby rim of the bed.

15. The method according to claim 13, further comprising a step of providing the covering layer by laying of natural or artificial stones, which are arranged mutually adjacent, are joined by a bonding agent, and are arranged to form interstices for passage of water to the waterproofing layer, so that pressure of the water is discharged against said waterproofing layer without compromising integrity of the covering layer.

* * * * *